US005823372A

United States Patent [19]

Levine

[11] Patent Number: 5,823,372

[45] Date of Patent: Oct. 20, 1998

[54] PUMP INSERT FOR BOTTLE CAPS

[76] Inventor: Alan Levine, 7511 Prescott La., Lake Worth, Fla. 33467

[21] Appl. No.: 14,849

[22] Filed: Jan. 28, 1998

[51] Int. Cl.[6] ..... B65D 51/24

[52] U.S. Cl. ..... 215/228; 215/355

[58] Field of Search ..... 215/228, 355; 220/212

[56] References Cited

U.S. PATENT DOCUMENTS

| | | | |
|---|---|---|---|
| 2,582,721 | 1/1952 | Roshkind . | |
| 3,557,986 | 1/1971 | Poole, Jr. . | |
| 3,602,387 | 8/1971 | Patasude et al. . | |
| 3,672,114 | 6/1972 | Sacks . | |
| 4,033,091 | 7/1977 | Saponara | 215/228 X |
| 4,524,877 | 6/1985 | Saxby et al. . | |
| 4,640,426 | 2/1987 | Wasley . | |
| 4,723,670 | 2/1988 | Robinson et al. | 215/228 |
| 4,763,802 | 8/1988 | Johnston | 215/228 |
| 4,823,968 | 4/1989 | Handzlik . | |
| 4,981,233 | 1/1991 | Scheurer . | |
| 5,154,112 | 10/1992 | Wettern | 215/228 X |
| 5,207,339 | 5/1993 | Shyu | 215/228 |
| 5,653,352 | 8/1997 | Kim | 215/228 |

*Primary Examiner*—Stephen K. Cronin

[57] ABSTRACT

A pump adapted for insertion between a cap and a carbonated-beverage bottle for re-pressurizing the interior of the bottle with air, the pump comprising: a hollow, resilient, expandable and compressible body, the body having a sealed upper end and a lower end; a flanged lip seal formed around an outer circumference of the upper end of the hollow body and adapted for engaging an inside recess of a standard bottle cap; the upper end of the hollow body having a hole therethrough; a membrane closing the lower end of the hollow body, the membrane containing a normally sealed opening adapted to open in response to an increase in pressure caused by compression of the hollow body; and, a collar extending from the lower end of the hollow body and adapted to sealingly engage a bottle neck upon engagement of the collar with the bottle neck.

20 Claims, 2 Drawing Sheets

PUMP INSERT FOR BOTTLE CAPS

BACKGROUND OF THE INVENTION

1. Field of the Invention

This invention relates to the field of bottle caps for carbonated beverages, and in particular, to a bottle cap pump insert for re-pressurizing the carbonated beverage and air chamber inside a carbonated beverage bottle after the bottle has been opened.

2. Description of Related Art

An integral aspect of the pleasing flavor of most carbonated beverages is the carbonation contained in solution in the beverage. However, after its initial opening, carbonation contained in the beverage solution constantly seeks to escape and obtain equilibrium with the ambient pressure surrounding it, either with the atmosphere if the container is left unsealed or with the air chamber within the beverage container if it is resealed. Upon each subsequent opening of the container, more of the pressurized gas that originated from solution within the carbonated beverage and resided in the air chamber of the container escapes into the atmosphere. Unfortunately, after only a few openings, enough gas escapes solution in search of equilibrium to cause a noticeable deterioration of the original and intended flavor of the beverage.

A bottle cap for pressurizing a previously opened bottle containing a carbonated beverage is taught in U.S. Pat. No. 4,640,426. The cap includes a bulb that functions as a pump. The pump includes three spring-loaded ball valves and is extremely complicated and expensive to manufacture. Moreover, the cap is not suitable for use on the bottle as the original cap.

A bottle cap for pressurizing a previously opened bottle containing a carbonated beverage is taught in U.S. Pat. No. 3,557,986. The cap also includes a bulb that functions as a pump. This cap is simpler in construction, but is also unsuitable for use on the bottle as the original cap.

There is a long felt and unfulfilled need in the art for a bottle cap assembly for a carbonated beverage bottle which can be used to re-pressurize the bottle after opening, which is simple in construction and inexpensive to manufacture, and which can occupy a small enough volume as to be used as an insert even in the original cap for the bottle, if desired by a bottler or beverage company.

SUMMARY OF THE INVENTION

The invention taught herein satisfies this long felt and unfulfilled need. A pump insert for re-pressurizing the carbonated beverage enables soda manufacturers and bottlers to provide an effective and efficient means for consumers to preserve the flavor of their products by maintaining carbonation in solution of the beverage until the carbonated beverage contents of a bottle is fully consumed.

Such an insert for re-pressurizing the carbonated beverage in a bottle enables consumers to re-pressurize and seal outside air into the bottle upon each re-closure, thereby bringing the air chamber to a point of at or near equilibrium with the carbonation in solution in the beverage before the carbonation contained in solution has the opportunity to seek that same equilibrium and escape from the liquid. As a result, the original carbonation contained in the beverage remains in solution, thereby preserving the original and intended flavor of the beverage. The pump insert can be manufactured so inexpensively and is so compact in a resting or unused state that it can be supplied with the original bottle cap. Alternatively, the pump insert can be made available to consumers for use with original bottle caps.

In accordance with the foregoing, it is an aspect of the inventive arrangements taught herein to replace and expand the functionality of the seal currently found inside the caps of carbonated beverage bottles. In addition to behaving in a manner so as to seal the liquid and gasses inside a carbonated beverage bottle, the insert will also later serve as a pump to repressurize the bottle and its contents after its initial opening. The insert will fit within the boundaries of existing caps and bottle necks, thereby retaining all existing dimensions of the various standard a sealed common carbonated beverage bottle.

In accordance with the inventive arrangements, the pump insert provides a number of advantages over the prior art. The pump insert can be a single piece unit with no friction bearing parts to wear out. The pump insert can be a single piece unit requiring no manual or automated assembly of parts, thereby reducing greatly many of the manufacturing costs incurred with other devices. The pump insert can be a single piece unit with a short usage lifetime, which eliminates the possibility of any components dislodging and contaminating the beverage or being accidentally ingested by mistake. The pump insert can be integrated in the bottling process of all beverage bottles, eliminating any need to transfer a device from bottle to bottle. The pump insert can be disposable upon the discarding or recycling of the empty beverage container and cap, so that the possibility of dirt or bacteria being retained and accumulated in tiny recesses of more complex devices, such as those utilizing springs, pistons, and/or valves, is completely eliminated.

A pump adapted for insertion between a cap and a carbonated-beverage bottle for re-pressurizing the interior of the bottle with air, in accordance with an inventive arrangement, comprises: a hollow, resilient, expandable and compressible body, the body having a sealed upper end and a lower end; a flanged lip seal formed around an outer circumference of the upper end of the hollow body and adapted for engaging an inside recess of a standard bottle cap; the upper end of the hollow body having a hole therethrough; a membrane closing the lower end of the hollow body, the membrane containing a normally sealed opening adapted to open in response to an increase in pressure caused by compression of the hollow body; and, a collar extending from said lower end of said hollow body and adapted to sealingly engage a bottle neck upon engagement of said collar with said bottle neck.

In a presently preferred embodiment, the collar comprises an angled collar extending exteriorly from the lower end of the hollow body and adapted to sealingly engage an inside of the bottle neck upon insertion of the angled collar into the bottle neck.

The membrane is preferably mammillated to include a normally sealed incision adapted to open in response to an increase in pressure caused by compression of the hollow body.

The hole in the upper end of the hollow body is adapted to sealingly seat against the standard bottle cap upon a manual compression of the hollow body and adapted to unseat to allow air into the pump in response to a manual expansion of the hollow body.

The angled collar preferably comprises an annulus about an upper area adapted to seat atop the bottle neck.

The flanged lip seal and an annulus about the upper area of the angled collar are preferably adapted to form a seal upon normal closure of the beverage bottle.

The hollow body is adapted to be disposed interiorly of the angled collar upon compression of the hollow body.

The pump is advantageously adapted to fit inside a normally sealed beverage bottle while in a compressed state.

The pump preferably comprises a one piece device made of elastomeric material.

A pump adapted for insertion between a cap and a carbonatedis beverage bottle for re-pressurizing the interior of the bottle with air in accordance with a further inventive arrangement comprises: a hollow, resilient, expandable and compressible body, the body having a sealed upper end and a lower end; the closed upper end of the hollow body having a hole therethrough; a membrane closing the lower end of the hollow body, the membrane containing a normally sealed opening adapted to open in response to an increase in pressure caused by compression of the hollow body; and, a collar extending from said lower end of said hollow body and adapted to sealingly engage a bottle neck upon engagement of said collar with said bottle neck.

In a presently preferred embodiment, the collar comprises an angled collar extending exteriorly from the lower end of the hollow body and adapted to sealingly engage an inside of the bottle neck upon insertion of the angled collar into the bottle neck.

The membrane is preferably mammillated to include a normally sealed incision adapted to open in response to an increase in pressure caused by compression of the hollow body.

The angled collar comprises an annulus about an upper area adapted to seat atop the bottle neck.

The hollow body is adapted to be disposed interiorly of the angled collar upon compression of the hollow body.

The pump is advantageously adapted to fit inside a normally sealed beverage bottle while in a compressed state.

The pump preferably comprises a one piece device made of elastomeric material.

An apparatus for sealing and pressurizing a bottle in accordance with another inventive arrangement comprises: a bottle cap having a top and an annular portion extending therefrom and defining an interior cap space, the annular portion having an inwardly directed thread for engaging a bottle neck outer threaded surface; an expandable and compressible bellows having a first end with an opening and with a flange lip seated in the cap, the bellows being disposed substantially within the interior cap space and spaced inwardly from the threaded surface when the bellows is compressed; the opening, the cap and the flange lip forming a first one-way valve for filling the bellows with air; the bellows having a second end with a second one-way valve for expelling air from the bellows, the second end of the bellows extending out of the interior space when the bellows is expanded; and, a collar extending from the second end of the bellows for sealably engaging the bottle neck, whereby the expansion and compression of the bellows by movement of the cap relative to the bottle neck pumps air into the bottle, the bottle being resealable by compression of at least one of the flange lip and the collar between the cap and the bottle neck when the cap is threadably tightened onto the bottle neck.

In a presently preferred embodiment, the collar frictionally engages the bottle neck.

A pump insert for a bottle cap having a top and an annular portion extending therefrom and defining an interior cap space, the annular portion having an inwardly directed thread for engaging a bottle neck outer threaded surface, in accordance with yet another inventive arrangement, comprises: an expandable and compressible bellows having a first end with an opening and with a flange lip adapted for seating in the cap, the bellows being disposed substantially within the interior cap space and spaced inwardly from the threaded surface when the flange lip is seated in the cap and the bellows is compressed; the opening, the cap and the flange lip forming a first one-way valve for filling the bellows with air; the bellows having a second end with a second one-way valve for expelling air from the bellows, the second end of the bellows extending out of the interior space when the bellows is expanded; and, a collar extending from the second end of the bellows for sealably engaging the bottle neck, whereby the expansion and compression of the bellows by movement of the cap relative to the bottle neck pumps air into the bottle, the bottle being resealable by compression of at least one of the flange lip and the collar between the cap and the bottle neck when the cap is threadably tightened onto the bottle neck.

In a presently preferred embodiment, the collar frictionally engages the bottle neck.

BRIEF DESCRIPTION OF THE DRAWINGS

There are shown in the drawings forms which are presently preferred, it being understood, however, that the invention is not limited to the precise arrangements and instrumentalities shown.

DETAILED DESCRIPTION OF THE PREFERRED EMBODIMENTS

Figure 1:
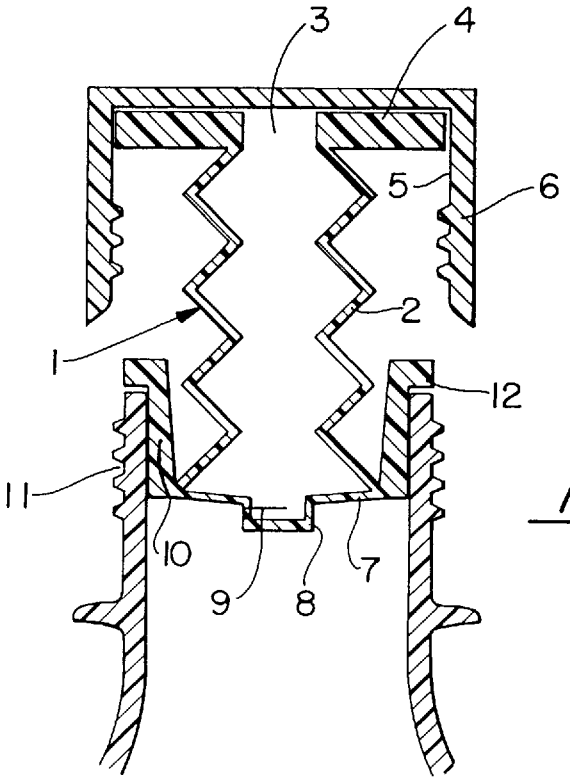
FIG. 1 is a vertical cross-section of the pump insert for re-pressurizing a carbonated beverage bottle in accordance with the inventive arrangements, in a position enabling air to be pumped into the bottle.
Figure 2:
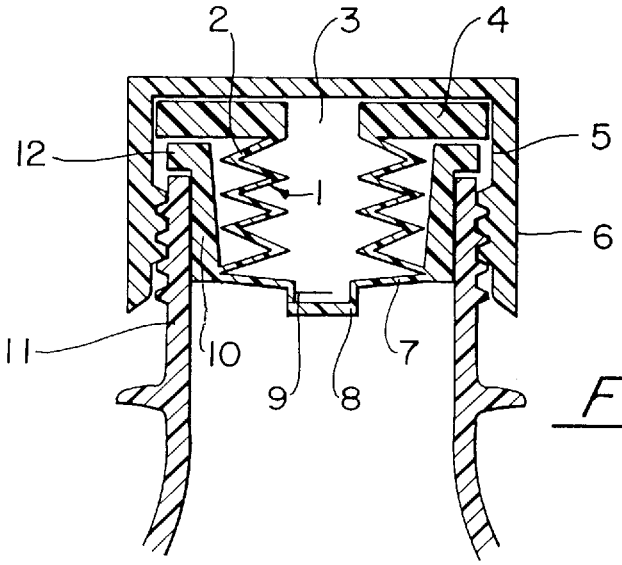
FIG. 2 is a view similar to FIG. 1, but showing the pump insert in its sealed position with the cap reattached to the bottle.

Reference is now directed to FIGS. 1 and 2 of the drawings wherein the pump insert as a unit is designated by the numeral (1). The pump insert (1) is a single piece molded cylindrical device made of elastic material. The elastic material required for the pump insert need be able to retain a predefined shape and flex repeatedly without fracturing. Materials available for this requirement include polyethylene, polypropylene, vinyl, latex, rubber, various plasticized materials, etc. The pump insert comprises a hollow expandable and compressible cylindrical chamber (2) open at its upper end (3) and designed in an accordion like shape so that when compressed, folds tightly unto itself. At the top of the chamber is a flanged lip seal (4) that firmly seats the pump inside the upper inside recess (5) of an existing bottle cap (6) above the threaded area.

At the lower end of the chamber and closing its bottom is a self-sealing mammillated membrane (7), the nipple area (8) of which contains an incision (9). From the exterior of the lower area of the chamber begins the bottom of an angled cylindrical collar (10) tapered so that when descended into the inside of the neck of a beverage bottle (11), seats the entire insert snugly and in a sealing manner to the inside of the neck of the beverage container. At the upper end of the collar extends an annulus (12) that provides a stop for the collar so as not to insert it too far into the neck of the container, and also serves as that part of the insert for the consumer to squeeze and pull upon, after unscrewing the cap, to disengage the unit from the bottle.

Figure 3:
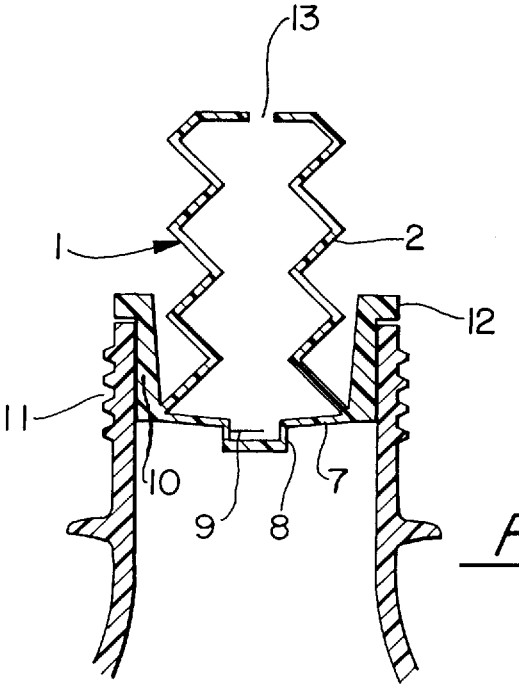
FIG. 3 is similar to FIG. 1, but showing an embodiment of the pump insert not attached to a bottle cap, but which can be used with an existing bottle cap.

The device shown in FIG. 3 is similar to that in FIGS. 1 and 2 except that the upper end of the hollow chamber is closed, except for the presence of a small hole (13), and does not contain a flanged lip seal (4) and therefore does not engage or employ the cap.

In operation, the embodiment shown in FIGS. 1 and 2 the pump insert is intended to be included on carbonated beverage bottles during the bottling process. The first involvement the consumer will have with the insert will be to simply unscrew the bottle cap (6), expose the insert (1) and then squeeze and pull upon the annulus (12) to disengage the insert from the beverage container.

Upon re-closure of the container, the angled collar (10) is inserted into the bottle neck (11) until it is snug in a sealing manner with the bottle and the annulus is seated against the top of the beverage container. The user then compresses the chamber (2) by pushing down on the cap (6). This action seats the cap over the opening (3) at the top of the chamber and forces air inside the pump insert to exit through the incision (9) in the nipple (8) in the mammillated membrane (7) and into the beverage bottle. Upon completion of the downstroke, the incision in the nipple seals itself and the recently pressurized air inside the bottle by the act of three forces. These forces are: a) the higher than ambient pressure now inside the soda bottle forcing against the underside of the nipple; (b) the suction/vacuum pressure created by the expansion of the chamber above it on the subsequent intake stroke; and, c) the elasticity of the material returning it to its normally relaxed and closed position. The ensuing upstroke, conducted in part by allowing the elastic material to return to its normally relaxed shape, but principally by gently pulling up on the bottle cap with the pump insert firmly seated inside it via the flanged lip seal (4), allows outside air to enter the pump insert through the opening at its upper end, the middle of which flexes away from the cap on the upstroke. The opening, the cap and the flange lip form a one-way valve for filling the bellows with air from outside of the bottle. The downstroke (compression) and upstroke (intake) process is repeated until the plastic bottle begins to feel firm to the hand upon squeezing.

The pressurized air remains sealed in the bottle by securing the bottle cap to the bottle neck. This creates a continuous and tight seal around the circumference of the bottle neck opening by forcing the top of the bottle neck (11) against the annulus (12), the annulus against the flanged lip seal (4), and the flanged lip seal against the bottle cap (6). Because of the arrangement of the flanged lip seal, the annulus, the bottle, and the cap, the incision (9) in the nipple (8) in the membrane (7) need seal only during the pressurizing process and any air or liquid that may leak through it remains within the confines of the sealed bottle.

In operation, the embodiment shown in FIG. 3 is operated in much the same manner as the device in FIGS. 1 and 2, except that instead of using the cap to seal the opening in, and compress the hollow cylinder, the consumer employs their palm, finger, etc. to seal the upper hole (13) and compress the pump insert. On the intake upstroke, the hole is unsealed to allow air into the chamber for its re-expansion. Contents remain sealed in the bottle by the continuous sealing contact made by the bottle neck, the annulus, and the cap.

In each of the embodiments, the frictional sealing engagement between the angled collar and the bottle neck prevents the bottle from being over pressurized, as the frictional seal will open when the pressure exceeds the frictional engaging force.

While the embodiments of the invention have been illustrated and described in detail, it is to be expressly understood that the invention is not limited thereto. Various changes can be made in the design and arrangements of its aspects without departing from the spirit, scope, and intent of the invention.

It is my intent therefore to claim the invention not only as shown and detailed herein, but also in all such forms and modifications as may reasonably be construed to fall within the spirit of the invention and the scope of the appended claims.

What is claimed is:

1. A pump adapted for insertion between a cap and a carbonated-beverage bottle for re-pressurizing the interior of the bottle with air, the pump comprising:

a hollow, resilient, expandable and compressible body, said body having an upper end and a lower end;

a flanged lip seal formed around an outer circumference of said upper end of said hollow body and adapted for engaging an inside recess of a standard bottle cap;

said upper end of said hollow body having a hole therethrough;

a membrane closing said lower end of said hollow body, said membrane containing a normally sealed opening adapted to open in response to an increase in pressure caused by compression of said hollow body; and, a collar extending from said lower end of said hollow body and adapted to sealingly engage a bottle neck upon engagement of said collar with said bottle neck.

2. The pump of claim 1, wherein said collar comprises an angled collar extending exteriorly from said lower end of said hollow body and adapted to sealingly engage an inside of said bottle neck upon insertion of said angled collar into said bottle neck.

3. The pump of claim 1, wherein said membrane is mammillated to include a normally sealed incision adapted to open in response to an increase in pressure caused by compression of said hollow body.

4. The pump of claim 1, wherein said hole in said upper end of said hollow body is adapted to sealingly seat against said standard bottle cap upon a manual compression of said hollow body and adapted to unseat to allow air into said pump in response to a manual expansion of said hollow body.

5. The pump of claim 1, wherein said collar comprises an annulus about an upper area adapted to seat atop said bottle neck.

6. The pump of claim 1, wherein said flanged lip seal and an annulus about said upper area of said collar are adapted to form a seal upon normal closure of said beverage bottle.

7. The pump of claim 1, wherein said hollow body is adapted to be disposed interiorly of said collar upon compression of said hollow body.

8. The pump of claim 1, wherein said pump is adapted to fit inside a normally sealed beverage bottle while in a compressed state.

9. The pump of claim 1, comprising a one piece device made of elastomeric material.

10. A pump adapted for insertion between a cap and a carbonated-beverage bottle for re-pressurizing the interior of the bottle with air, the pump comprising:

a hollow, resilient, expandable and compressible body, said body having an upper end and a lower end;

said upper end of said hollow body having a hole therethrough;

a membrane closing said lower end of said hollow body, said membrane containing a normally sealed opening adapted to open in response to an increase in pressure caused by compression of said hollow body; and, a collar extending from said lower end of said hollow body and adapted to sealingly engage a bottle neck upon engagement of said collar with said bottle neck.

11. The pump of claim 10, wherein said collar comprises an angled collar extending exteriorly from said lower end of said hollow body and adapted to sealingly engage an inside of said bottle neck upon insertion of said angled collar into said bottle neck.

12. The pump of claim 10, wherein said membrane is mammillated to include a normally sealed incision adapted to open in response to an increase in pressure caused by compression of said hollow body.

13. The pump of claim 10, wherein said collar comprises an annulus about an upper area adapted to seat atop said bottle neck.

14. The pump of claim 10, wherein said hollow body is adapted to be disposed interiorly of said collar upon compression of said hollow body.

15. The pump in claim 10, wherein said pump is adapted to fit inside a normally sealed beverage bottle while in a compressed state.

16. The pump in claim 10, comprising a one piece device made of elastomeric material.

17. An apparatus for sealing and pressurizing a bottle, comprising:

a bottle cap having a top and an annular portion extending therefrom and defining an interior cap space, said annular portion having an inwardly directed thread for engaging a bottle neck outer threaded surface;

an expandable and compressible bellows having a first end with an opening and with a flange lip seated in said cap, said bellows being disposed substantially within said interior cap space and spaced inwardly from said threaded surface when said bellows is compressed;

said opening, said cap and said flange lip forming a first one-way valve for filling said bellows with air;

said bellows having a second end with a second one-way valve for expelling air from said bellows, said second end of said bellows extending out of said interior space when said bellows is expanded; and, a collar extending from said second end of said bellows for sealably engaging said bottle neck, whereby said expansion and compression of said bellows by movement of said cap relative to said bottle neck pumps air into said bottle, said bottle being resealable by compression of at least one of said flange lip and said collar between said cap and said bottle neck when said cap is threadably tightened onto said bottle neck.

18. The apparatus of claim 17, wherein said collar frictionally engages said bottle neck.

19. A pump insert for a bottle cap having a top and an annular portion extending therefrom and defining an interior cap space, said annular portion having an inwardly directed thread for engaging a bottle neck outer threaded surface, said pump insert comprising:

an expandable and compressible bellows having a first end with an opening and with a flange lip adapted for seating in said cap, said bellows being disposed substantially within said interior cap space and spaced inwardly from said threaded surface when said flange lip is seated in said cap and said bellows is compressed;

said opening, said cap and said flange lip forming a first one-way valve for filling said bellows with air;

said bellows having a second end with a second one-way valve for expelling air from said bellows, said second end of said bellows extending out of said interior space when said bellows is expanded; and, a collar extending from said second end of said bellows and adapted for sealably engaging said bottle neck, whereby said expansion and compression of said bellows by movement of said cap relative to said bottle neck pumps air into said bottle when said collar frictionally sealably engages said bottle neck, said bottle being resealable by compression of at least one of said flange lip and said collar between said cap and said bottle neck when said cap is threadably tightened onto said bottle neck.

20. The apparatus of claim 19, wherein said collar frictionally engages said bottle neck.

* * * * *